US005261701A

United States Patent [19]

Walters

[11] Patent Number: 5,261,701

[45] **Date of Patent: * Nov. 16, 1993**

[54] EXPANSION POCKET

[75] Inventor: Robert N. Walters, Washington, Mo.

[73] Assignee: American Trading and Production Corporation, Baltimore, Md.

[ * ] Notice: The portion of the term of this patent subsequent to Jun. 2, 2009 has been disclaimed.

[21] Appl. No.: 878,462

[22] Filed: May 5, 1992

Related U.S. Application Data

[63] Continuation-in-part of Ser. No. 658,770, Feb. 21, 1991, Pat. No. 5,118,137.

[51] Int. Cl.[5] ..... B42D 3/00; B42D 3/18

[52] U.S. Cl. ..... 281/31; 281/29; 229/72; 229/101; 40/159; 150/144; 150/146; 383/120

[58] Field of Search ..... 251/29, 31, 15.1; 40/159, 405, 537; 150/144, 145, 146; 229/72, DIG. 3

[56] References Cited

U.S. PATENT DOCUMENTS 1,866,618 7/1932 Buxton .

FOREIGN PATENT DOCUMENTS 919037 2/1947 France .
1157993 6/1958 France .
1346640 11/1963 France .

OTHER PUBLICATIONS

*Miller's Office Products*, 1989 Catalogue; p. 248.

*Primary Examiner*—Paul A. Bell
*Attorney, Agent, or Firm*—Vidas, Arrett & Steinkraus

[57] ABSTRACT

An expansion pocket is provided for use with folders, binders or the like which allows large quantities of materials to be securely inserted into the expansion pocket. The expansion pocket cover member is provided with a series of slits which run along the two adjacent edges of the cover member secured to the folder or ring binder, along with a relief cut-out made in the cover member at the corner defined by these two adjacent sides.

5 Claims, 2 Drawing Sheets

EXPANSION POCKET

CROSS-REFERENCE TO RELATED APPLICATIONS

This application is a continuation-in-part of U.S. patent application Ser. No. 07/658,770 filed Feb. 21, 1991 by the inventor under the title "Expansion Pocket", now U.S. Pat. No. 5,118,137. This application is incorporated herein by reference.

BACKGROUND OF THE INVENTION

1. Field Of The Invention

This invention relates to an expansion pocket for holding materials in a folder, a binder or the like.

2. Description Of The Related Art

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

U.S. Pat. No. 4,848,798 entitled "Perforated Interior Binder Pocket" issued Jul. 18, 1989 to Meed Corporation, is directed to a binder or portfolios which contains a interior pocket which is perforated. The perforations allow for the establishment of visual contact with the contents contained in the pocket.

U.S. Pat. No. 2,473,056 entitled "Billfold With Gusset Pocket" issued Jun. 14, 1949 to Springfield Leather Products Co, is directed to a billfold which has a pocket which is expansible. However it does not utilize a series of slits which allow it to lay flat when not in use.

SUMMARY OF THE INVENTION

Prior art pockets used with binders, folders, portfolios, wallets, billfolds, passport cases, case bound books, or the like hold only a limited amount of material before the very quantity of material forces the material to fall out of the pocket, due to the limited room provided where the pocket is joined or attached to the underlying support. Applicant's inventive expansion pocket overcomes this disadvantage by providing a series of parallel slits which run along the edges of the expansion pocket cover member which are attached to the folder or binder, and a relief cut-out at the corner of these two sides. The relief cut-out and the slits allow the pocket cover member to lift or expand at the two edges where the pocket cover member is attached to the binder or folder. This allows much more material to fit securely into the pocket.

BRIEF DESCRIPTION OF THE DRAWINGS

FIG. 2 shows the expansion pocket cover member prior to installation into a binder or folder or the like;

DESCRIPTION OF THE PREFERRED EMBODIMENTS

Figure 1:
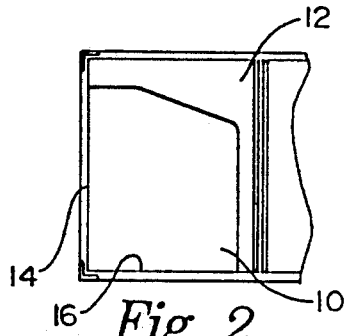
Fig. 1 PRIOR ART
FIG. 1 is a drawing showing a prior art expansion pocket.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

Referring now to FIG. 1, a prior art expansion pocket 10 is shown attached to the inside of a binder, foler, portfolio, wallet, billfold, passport case, case bound book or the like 12. In this prior art example the pocket is formed of a material such as vinyl which also covers the inside and outside of cover 12. The vinyl pocket 10 is bonded, attached, or sealed to cover 12 along edges 14 and 16, as is well known in the art. Because of the method of attaching expansion pockets of this type they are only able to hold a limited quantity of material. Only a few sheets or so of material will actually slide all the way into the expansion pocket over to edges 14 and 16. Because of the nature of prior art expansion pockets additional material will not be properly held by the expansion pocket and becomes loose and falls out.

Figure 2:
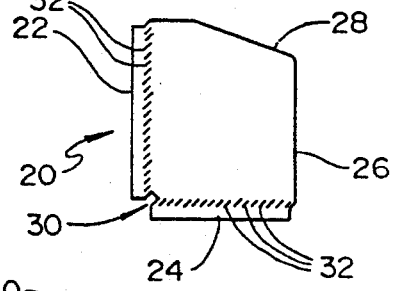

Applicant's inventive expansion pocket cover member is referred to generally in FIG. 2 as 20. Expansion pocket cover member 20 can be made out of any suitable material such as leather, vinyl, polymeric substances such as polyester, paper products or the like. Expansion pocket cover member 20 can also be sized as desired, although the expansion pocket cover member shown in FIG. 2 is sized to hold $8\frac{1}{2} \times 11$ materials. Like the prior art expansion pockets, expansion pocket cover member 20 is designed to be attached to the folder, ring binder or portfolio by sides 22 and 24. Sides 26 and 28 are not attached, thereby allowing the insertion of materials into the expansion pocket.

Expansion pocket cover member 20 also includes a relief cut-out referred to generally at 30 and a series of slits at 32 along edges 22 and 24 of expansion pocket cover member 20. Relief cut-out 30 may be provided in any desired shape. The critical feature of the relief cut-out being that the corner between sides 22 and 24 of expansion pocket cover member 20 be unattached to the folder or binder to provide stress release to the expansion pocket cover member as materials are inserted. Slits 32 must extend all the way through expansion pocket cover member 20. In the preferred embodiment slits 32 are linear, and may be from $\frac{1}{4}$ to $\frac{1}{2}$ inch in length, although any length may be used as long as it provides stress relief. It is also important to note that the slits do not have to be linear, but can be any shape as long as they provide stress relief. In the preferred embodiment slits 32 are parallel to each other, and also parallel to the line which would bisect the corner of the expansion pocket cover member 20 if no relief cut-out 30 were provided. Slits 32 and relief cut-out 30, in combination, allow the expansion pocket cover member 20 to lift up an additional ¼ to ½ inch in height, depending on the length of slits 32, along edges 22 and 24, so that the expansion 20 may hold large quantities of materials. When the expansion pocket cover member 20 is actually attached to the folder or binder the edge of slits 32 closest to the edges 22 and 24 actually define the attached sides of the expansion pocket. The extra material outside slits 32 is provided for attachment purposes, either by bonding, sealing, sewing or other means well known in the art.

Figure 3:
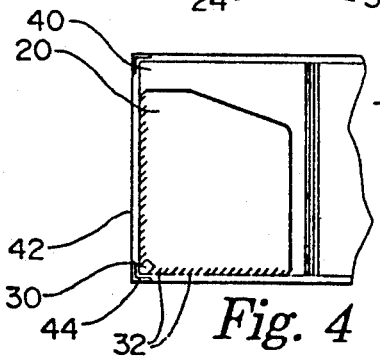
FIG. 3 shows the inventive expansion pocket cover member used in a sewn folder.

FIG. 3 shows expansion pocket cover member 20 used in a sewn folder. The expansion pocket cover member 20 is attached to the supporting base member 40, thereby forming the actual expansion pocket. The supporting base member 40 can be a stiffener covered with a covering material, although a stiffener is not required. The supporting base member 40 forms the bottom side of the expansion pocket while expansion pocket cover member 20 forms the top side of the expansion pocket. Cover member 42 may be added to enhance the appearance of the folder by covering the sewing used to attach pocket cover member 20 to supporting base member 40, although cover member 42 is not necessary to the invention. Similarly, decorative corner 44 may be added if desired. It should also be noted that slits 32 abut the edge defined by cover member 42, thereby defining two edges of the expansion pocket.

Figure 4:
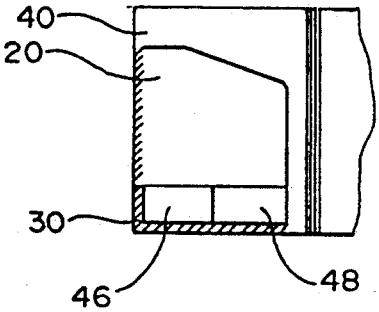
FIG. 4 shows the inventive expansion pocket cover member used in a sealed folder along with some optional additional pockets.

FIG. 4 shows the expansion pocket cover member 20 used in a sealed folder. Additional pockets 46 and 48 may be attached to pocket cover member 20 to provide additional storage if desired.

Figure 5:
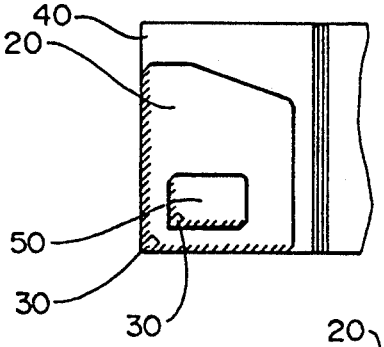
FIG. 5 shows the inventive expansion pocket cover member of FIG. 4 including a separate expansion pocket cover member.

FIG. 5 shows the embodiment of FIG. 4 with a secondary expanding pocket 50 located on pocket cover member 20.

Figure 6:
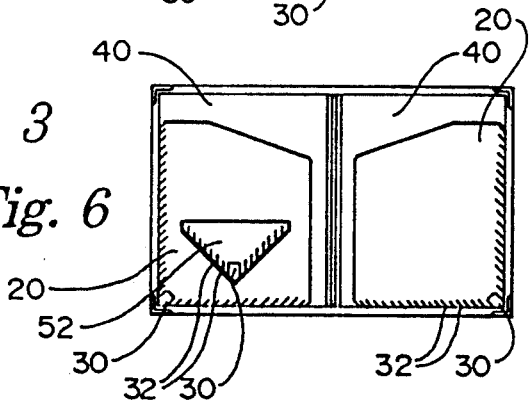
FIG. 6 shows the inventive expansion pocket cover member of FIG. 3 with an alternate embodiment of the additional expansion pocket cover member.

FIG. 6 shows that the inventive expanding pocket may be used on either or both sides of the folder, binder or the like. Secondary pocket 52 is included to show that the pocket does not necessarily need to be rectangular in shape. All that is necessary to the invention is that only two adjacent sides, along with the relief cut-out between those two adjacent sides, be attached to the underlying supporting base member. The underlying supporting base member may be a front or back cover, a stiffening member, or a primary expansion pocket cover member 20.

Figure 7:
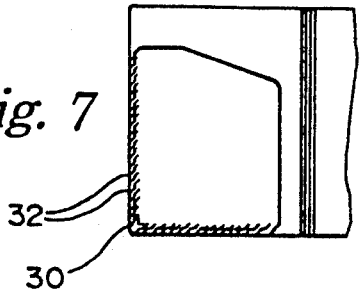
FIG. 7 shows an alternate embodiment of the slit shape.

FIG. 7 refers to an S-shaped slit pattern that may be used in place of the linear slit pattern 32. Any shape could be used for slits 32, the critical feature being that the slits provide relief to expansion pocket cover member 20 along the edges 22 and 24, allowing the cover member 20 to lift and move toward edges 22 and 24 as large amounts of material are inserted in the expansion pocket.

Figure 8:
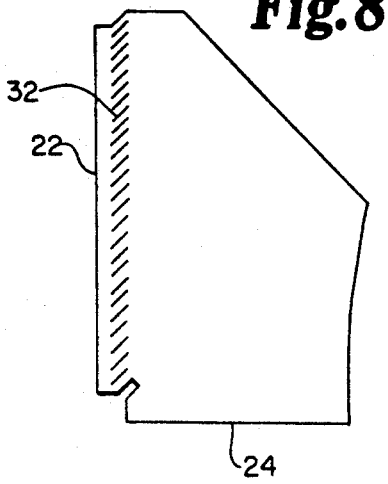
FIG. 8 shows an alternate embodiment of the inventive expansion pocket cover member with slits along only one side of the expansion pocket cover member.

FIG. 8 refers to an alternate embodiment of the inventive expansion pocket in which slits 32 are included along only one of the two sides on either side of the cut-out 30. The slits could run along either side 22 or side 24. While this is not the preferred embodiment of this invention, the inclusion of a relief cut-out 30 and a series of slits 32 running along either side 22 or side 24 would provide some expansion.

Figure 9:
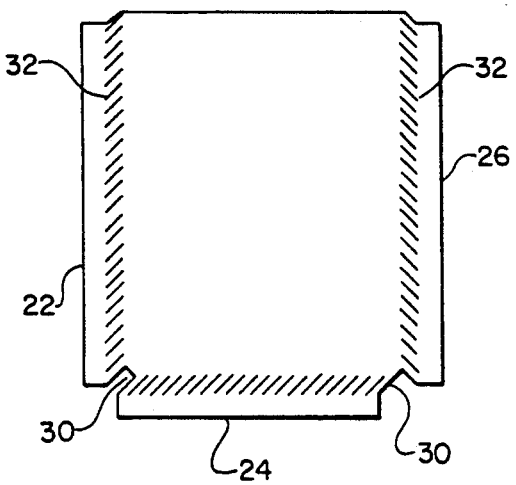
FIG. 9 shows an alternate embodiment of the inventive expansion pocket cover member including cut-outs in both bottom corners and slits along three sides.

FIG. 9 refers to an alternate embodiment of the inventive expansion pocket in which all three sides 22, 24, and 26 of the expansion pocket cover member 20 include a series of slits 32. The bottom corners of the cover member 20, between sides 22 and 24, and sides 24 and 26 each include a relief cut-out 30. This arrangement allows the entire cover member to lift up an additional ¼ to ½ inch in height, depending of the length of slits 32, along edges 22, 24, and 26 so that the expansion 20 may hold large quantities of materials.

Figure 10:
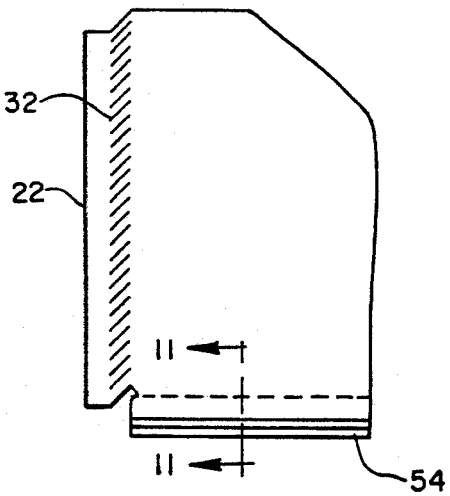
FIG. 10 shows an alternate embodiment of the inventive expansion pocket cover member including a gusseted feature.
Figure 11:
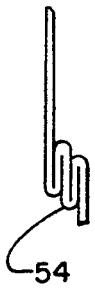
FIG. 11 is a fragmentary section taken along line 11—11 in FIG. 10 and slightly enlarged.

FIGS. 10 and 11 refer to an alternate embodiment of the inventive expansion pocket in which slits 32 are replaced by gussets 54. While not preferred, gussets 54 could be used to replace the expansion of slits 32 along one or more of sides 22, 24, and 26.

While the invention was primarily described in connection with an expansion pocket for use with binders and folders, the inventive expansion pocket may be used in connection with any item provided with a pocket. This would include folders, binders, portfolios, wallets, billfolds, passport cases, case bound books, disk cases, boxes, and the like.

This completes the description of the preferred and alternate embodiments of the invention. Those skilled in the art may recognize other equivalents to the specific embodiment described herein which equivalents are intended to be encompassed by the claims attached hereto.

What is claimed is:

1. An article including an expansion pocket, the article comprising:

a planar supporting base member;

an overlying cover member having a plurality of sides including two adjacent sides disposed from each other at a predetermined angle defining a corner, the corner being cut away to form a relief gap;

the cover member being attached to the base member by securing at least the two adjacent sides to the base member, the cover member covering at least a portion of the supporting base member;

cover member expansion means along at least one of the two adjacent sides near the area where the cover member is secured to the base member, thereby allowing the cover member to lift and move toward the corner, thereby acting as an expansion feature.

2. The article of claim 1 wherein the cover member expansion means is comprised of a plurality of slits being made in the overlying cover member along at least one of the two adjacent sides near the area where the cover member is secured to the base member, the slits being arranged to provide relief, thereby allowing the cover member to lift and move toward the corner, thereby acting as an expansion feature.

3. The article of claim 1 wherein the cover member expansion means is comprised of a gusseted section in the overlying cover member along at least one of the two adjacent sides near the area where the cover member is secured to the base member, the gusseted section being arranged to provide relief, thereby allowing the cover member to lift and move toward the corner, thereby acting as an expansion feature.

4. The article of claim 2 wherein the cover member has at least four sides, including three adjacent sides defining a right side, a left side and a bottom side between the right and left sides, the left side and bottom side defining a first corner, the right side and the bottom side defining a second corner, the first and second corners being cut away to form a pair of relief gaps;

a plurality of slits being made in the overlying cover member along the left, bottom and right sides near the area where the cover member is secured to the base member, the slits being arranged to provide relief, thereby allowing the cover member to lift and move toward the corners, thereby acting as an expansion feature.

5. An article including an expansion pocket, the article comprising:

a planar supporting base member;

an overlying cover member having a plurality of sides including two adjacent sides disposed from each other at a predetermined angle defining a corner, the corner being cut away to form a relief gap;

the cover member being attached to the base member by securing at least the two adjacent sides to the base member, the cover member covering at least a portion of the supporting base member;

a plurality of slits being made in the overlying cover member along at least one of the two adjacent sides near the area where the cover member is secured to the base member, the slits being arranged to provide relief, thereby allowing the cover member to lift and move toward the corner, thereby acting as an expansion feature.

* * * * *

UNITED STATES PATENT AND TRADEMARK OFFICE

CERTIFICATE OF CORRECTION

PATENT NO. : 5,261,701

DATED : November 16, 1993

INVENTOR(S) : Robert N. Walters

It is certified that error appears in the above-indentified patent and that said Letters Patent is hereby corrected as shown below:

Col. 2, line 28, delete "foler" and insert -- folder --

Signed and Sealed this

Nineteenth Day of April, 1994

Bruce Lehman

*Attest:*

BRUCE LEHMAN

*Attesting Officer*

*Commissioner of Patents and Trademarks*